US006738998B1

(12) United States Patent
Aubrey et al.

(10) Patent No.: US 6,738,998 B1
(45) Date of Patent: May 25, 2004

(54) FUTON FRAME THAT ASSEMBLES BY MEANS OF SOCKETS

(76) Inventors: David J. Aubrey, 5427 Johnson Dr., Mission, KS (US) 66205; Elizabeth P. Debauge, 5737 Harrison St., Kansas City, MO (US) 64110

( * ) Notice: Subject to any disclaimer, the term of this patent is extended or adjusted under 35 U.S.C. 154(b) by 0 days.

(21) Appl. No.: 10/458,111

(22) Filed: Jun. 10, 2003

(51) Int. Cl.[7] ..... A47C 17/04
(52) U.S. Cl. ..... 5/37.1; 5/12.1; 5/38
(58) Field of Search ..... 5/12.1, 37.1, 38, 5/47

(56) References Cited

U.S. PATENT DOCUMENTS

| | | | | | |
|---|---|---|---|---|---|
| 403,284 | A | * | 5/1889 | Newhouse | 5/38 |
| 898,399 | A | * | 9/1908 | Albert | 5/38 |
| 2,356,077 | A | * | 8/1944 | Mount | 5/38 |
| 2,438,127 | A | * | 3/1948 | Poskin | 5/38 |
| 2,494,105 | A | * | 1/1950 | Poskin | 5/38 |
| 2,724,841 | A | * | 11/1955 | Doube | 5/38 |
| 5,315,722 | A | * | 5/1994 | Djie | 5/37.1 |
| 5,429,415 | A | * | 7/1995 | Meade | 297/354.13 |
| 5,513,398 | A | * | 5/1996 | Dodge | 5/37.1 |
| 5,644,804 | A | * | 7/1997 | Wang | 5/12.1 |
| 5,815,858 | A | * | 10/1998 | Dodge | 5/37.1 |
| 5,940,907 | A | * | 8/1999 | Stoler et al. | 5/37.1 |
| 5,960,491 | A | * | 10/1999 | Olender | 5/37.1 |
| 6,135,545 | A | * | 10/2000 | Liao | 297/124 |
| 6,349,431 | B1 | * | 2/2002 | Meade et al. | 5/37.1 |
| 6,357,062 | B1 | * | 3/2002 | Woll et al. | 5/37.1 |
| 6,427,261 | B1 | * | 8/2002 | Chadbourn | 5/18.1 |
| 6,427,262 | B1 | * | 8/2002 | Huang | 5/37.1 |

* cited by examiner

*Primary Examiner*—Teri Pham Luu

(57) ABSTRACT

The present invention comprises a futon frame having a seat and a backrest, two arms and two legs. The six parts can be assembled by the user without the use of tools or small parts, this being a major distinguishing feature of the invention. Parts are held securely in place through the use of sockets into which are inserted corresponding parts of the arms legs and backrest. The backrest is maintained in a couch position by chains which extend from the arms to the backrest and which can be disconnected in order to allow the backrest to be lowered so that the futon frame forms a bed, these chains also allow for the adjustment of the backrest's angle of inclination. This is done by modification of the distance between the armrests and backrest through selection and placement on the backrest of various individual links of the chain.

3 Claims, 20 Drawing Sheets

FUTON FRAME THAT ASSEMBLES BY MEANS OF SOCKETS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to futon frames, specifically a type of futon frame which can be assembled easily by the end user without the use of tools or small parts.

BACKGROUND OF INVENTION

Those familiar with the art are aware that some confusion exists concerning the terms futon, and futon frame, which are often used interchangeably. For the purposes of this patent application, the term futon refers to a type of mattress or cushioning device and the term futon frame refers to an article of furniture for supporting a futon.

Futon frames have been widely used for decades. Like sofas they provide a place to sit. They also can be converted into a bed by causing the seat portion and the back portion to become coplanar. In almost all cases they must be purchased unassembled and then assembled in the home of the end user, by the end user.

Whether manufactured from wood or metal, machine screws and/or wood screws are used to secure the various parts to one another. This is one of the features that makes them difficult and time consuming to assemble, so much so that often one skilled in the assembly of futon frames must be employed by the end user for that purpose.

U.S. Pat. No. 5,960,491 to Olender (1999), U.S. Pat. No. 6,357,062 to Woll et al. (2002), U.S. Pat. No. 5,815,858 to Dodge (1998), U.S. Pat. No. 5,940,907 to Stoler et al. (1999), U.S. Pat. No. 5,485,638 to Newton (1996), U.S. Pat. No. 5,628,076 to Newton (1997), and U.S. Pat. No. 5,513,398 to Dodge (1996), all show futon frame designs that must incorporate machine screws and/or wood screws in their assembly.

In practice, these designs are also quite flimsy, in addition to being difficult for those not mechanically inclined to assemble. Also these designs tend to require the efforts of at least two people for assembly. Additionally, these types of futon frames do not lend themselves to repeated disassembly. Wooden parts get broken, wooden and metal threads become stripped or cross threaded, pre-drilled holes in thin metal parts become misshapen thereby causing a deterioration of structural integrity. The numerous nuts bolts and screws often become lost.

The mechanisms, through which prior art wooden and metal futon frames are converted from a sofa to a bed, tend to be stiff and complicated requiring a certain amount of practice to affect. If done improperly, the act of converting prior art futon frames from bed to sofa and vice-versa can and often does damage them.

Many prior art futon frames, and almost all in common use have a maximum of two positions to which the backrest can be adjusted.

BACKGROUND OF INVENTION—OBJECTS AND ADVANTAGES

Accordingly objects and advantages of the present invention are:

(a) To provide the user with a very sturdy difficult to damage futon frame;

(b) To provide the user with a futon frame that can be assembled and disassembled very quickly and easily by almost any one person with no special abilities or skills;

(c) To provide the user with a futon frame that can be assembled without tools;

(d) To provide the user with a futon frame that is very portable due to the fact that it quickly and easily can be broken down into six easily manageable pieces;

(e) To provide the user with a futon frame which utilizes no small parts;

(f) To provide the user with a futon frame, the backrest portion of which can be adjusted to several reclining positions;

(g) To provide a stylish metal futon frame that is easy and inexpensive to manufacture;

(h) To provide the user with a reclining mechanism that is simpler and easier to use than those of prior art futon frames;

SUMMARY

The present invention comprises a futon frame having a seat, a backrest, two arms, and two legs. The backrest and the seat are secured to one another by means of permanently attached sockets and corresponding posts which allow the backrest to articulate with respect to the seat and which allow for easy removal of the backrest from the seat. The arms and legs are attached to the seat by means of sockets permanently attached to the seat and into which corresponding parts of the arms and legs can be inserted. The backrest is maintained in an upright position by means of chains permanently attached to the arms and attached to the backrest in a removable manner.

Attached to the backrest is a permanently attached support device capable of articulating with respect to the backrest, for maintaining the backrest in a position parallel to a supporting surface, such as a floor when the futon frame is in a bed position.

DRAWING REFERENCE NUMERALS

10) BACKREST
10A through 10K) slats
10N and 10P) backrest chain hooks
10U and 10V) backrest support receiver sockets
10W) backrest support
10X and 10Y) female half slip hinges
10Z) backrest perimeter
10AA and 10BB) backrest support floor protectors
12) SEAT
12A through 12K) slats
12L, 12M, 12N and 12P) leg receiver sockets
12U and 12V) armrest receiver sockets
12W) center support
12X and 12Y) male half slip hinges
12Z) seat perimeter
14)RIGHT ARMREST
14)A right backrest support chain
16) LEFT ARMREST
16A) left backrest support chain

18) RIGHT LEG
18A and 18B) right leg floor protectors
20) LEFT LEG
20A and 20B) left leg floor protectors
26) FUTON All parts referred to by numbers and letters are sub-parts of parts referred to by numbers only.

26, is not part of our invention, but is included for illustrational purposes.

DRAWING FIGURES

In the drawings the terms right, left, front and back, above, below, rearward, forward, upward and downward, refer to the relationship of the named parts to a person seated on a fully assembled futon frame, configured in a couch position, their back resting against a backrest.

FIG. 1) Perspective view, of a futon frame from the front and the right side showing a futon frame fully assembled and in a couch position, supporting a futon.

FIG. 2) Perspective view of a futon frame from the back and right side, showing futon frame fully assembled, in a couch position, supporting a futon. The dotted line indicates the operation of the backrest support.

FIG. 3) Perspective view from the back and right side supporting a futon. Both armrests are removed, and the backrest support is fully extended. The backrest is partially lowered.

FIG. 4) Perspective view of futon a frame from above, supporting a futon showing the futon frame in a bed position.

FIG. 5) Perspective view of a seat from above partially detailing its construction.

FIG. 6) Perspective view of a seat from below detailing the remainder of its construction.

FIG. 7) Perspective view of a seat seen from above showing it fully assembled.

FIG. 8) Perspective view of a seat seen from below, showing it fully assembled.

FIG. 9) Perspective view of a backrest seen from the front, partially detailing its construction.

FIG. 10) Perspective view of a backrest seen from the back showing additional aspects of its construction.

FIG. 11) Perspective view of a backrest leg showing how its receiver sockets are placed prior to attachment of backrest leg assembly to a backrest. This view also shows the placement of floor protectors.

FIG. 12) Perspective view of a backrest from the back, showing final attachment of a backrest leg.

FIG. 13) Perspective view of a backrest from the front, showing it fully assembled.

FIG. 14) Perspective view of a backrest seen from the back and below showing it fully assembled.

FIG. 15) Perspective view of one leg showing the attachment of floor protectors.

FIG. 16) Perspective view of one armrest with backrest support chain attached.

FIG. 17) Perspective view of a seat seen from below showing how legs are assembled onto the seat.

FIG. 18) Perspective view of a seat seen from above with legs attached. A backrest is also shown. Lines indicate how a backrest is attached to a seat.

FIG. 19) Perspective view of a seat, legs, and backrest assembled seen from the front. Both armrests are also shown as well as the way in which they are attached to a seat.

FIG. 20) Perspective view of our invention fully assembled. This figure details the means by which backrest support chains are attached to backrest chain hooks.

DESCRIPTION OF THE PREFERRED EMBODIMENT

FIG. 1 shows a futon of our invention fully assembled as it would appear in a couch position. A futon 26 is partially supported by a seat 12. The remainder of the futon 26 rests against a backrest 10. The upturned ends of legs 18 and 20 are inserted into leg receiver sockets 12L, 12M, 12N, and 12P, not visible in this drawing, which are welded or otherwise permanently attached to the underside of seat 12. Said leg receiver sockets are of a dimension sufficient to allow a rigid fit when the legs 18 and 20 are inserted.

The lower aspects of arms 14 and 16, are inserted into armrest receiver sockets 12U and 12V said armrest receiver sockets being welded or otherwise permanently attached to opposite ends of seat 12. Armrest receiver sockets 12U and 12V are of a dimension sufficient to allow a rigid fit when the armrests 14 and 16 are inserted into them.

Backrest support chains 14A and 16A are welded or otherwise permanently attached to armrests 14 and 16 at the ends not inserted into armrest receiver sockets 12U and 12V. A link of each of said backrest support chains is looped over backrest chain hooks 10N and 10P, thereby supporting backrest 10 in an upright or couch position. The angle of inclination of backrest 10 is adjusted by choosing different links of backrest support chains 14A and 16A to loop over backrest chain hooks 10N and 10P.

FIG. 2 shows a futon frame of our invention fully assembled as explained above, and seen from the back. Additionally, a backrest support 10W, associated backrest support receiver sockets 10U and 10V and their operation are indicated. Said backrest leg receiver sockets 10U and 10V, are placed over protrusions located on the uppermost portions of backrest leg 10W. Backrest leg receiver sockets 10U and 10V are then welded or otherwise permanently attached to the upper and middle portion, and on the back side of backrest 10. Said backrest support receiver sockets, 10U and 10V, are of a dimension sufficient to allow a rigid fit when the corresponding protrusions of backrest support 10W are inserted, but not so rigid as to impede the articulation of said backrest support. In this way backrest support 10W, can articulate from a position folded flat against backrest 10 to an extended position whereby it can support backrest 10 in a position above a floor, and coplanar with seat 12, when the futon frame is in a bed position. Also shown are male half slip hinges 12X and 12Y, which are welded or otherwise permanently attached to seat 12. Female half slip hinges 10X and 10Y are also shown and are permanently attached to backrest 10, and fit over male half slip hinges 12X, and 12Y so that backrest 10, can articulate relative to seat 12.

FIG. 3 shows a futon frame of our invention partially disassembled. Armrests 14 and 16, are removed, thereby releasing backrest 10, leaving it free to be folded down into a position coplanar with seat 12. Backrest support 10W is shown fully extended so as to be able to support backrest 10 in a position coplanar with seat 12. Center support 12W, is shown providing support to backrest 10, at a location where backrest 10 would otherwise have no support.

FIG. 4 shows a futon frame of our invention partially disassembled, viewed from above. Armrests 14 and 16 are removed. The futon frame is configured in a bed position supporting a futon 26. Right leg 20 and backrest leg 10W, can be seen supporting seat 12 and backrest 10, above a floor. Left leg 18 also provides support in the same way but cannot be seen in this drawing. Also shown is armrest receiver socket 12U.

Figure 11:
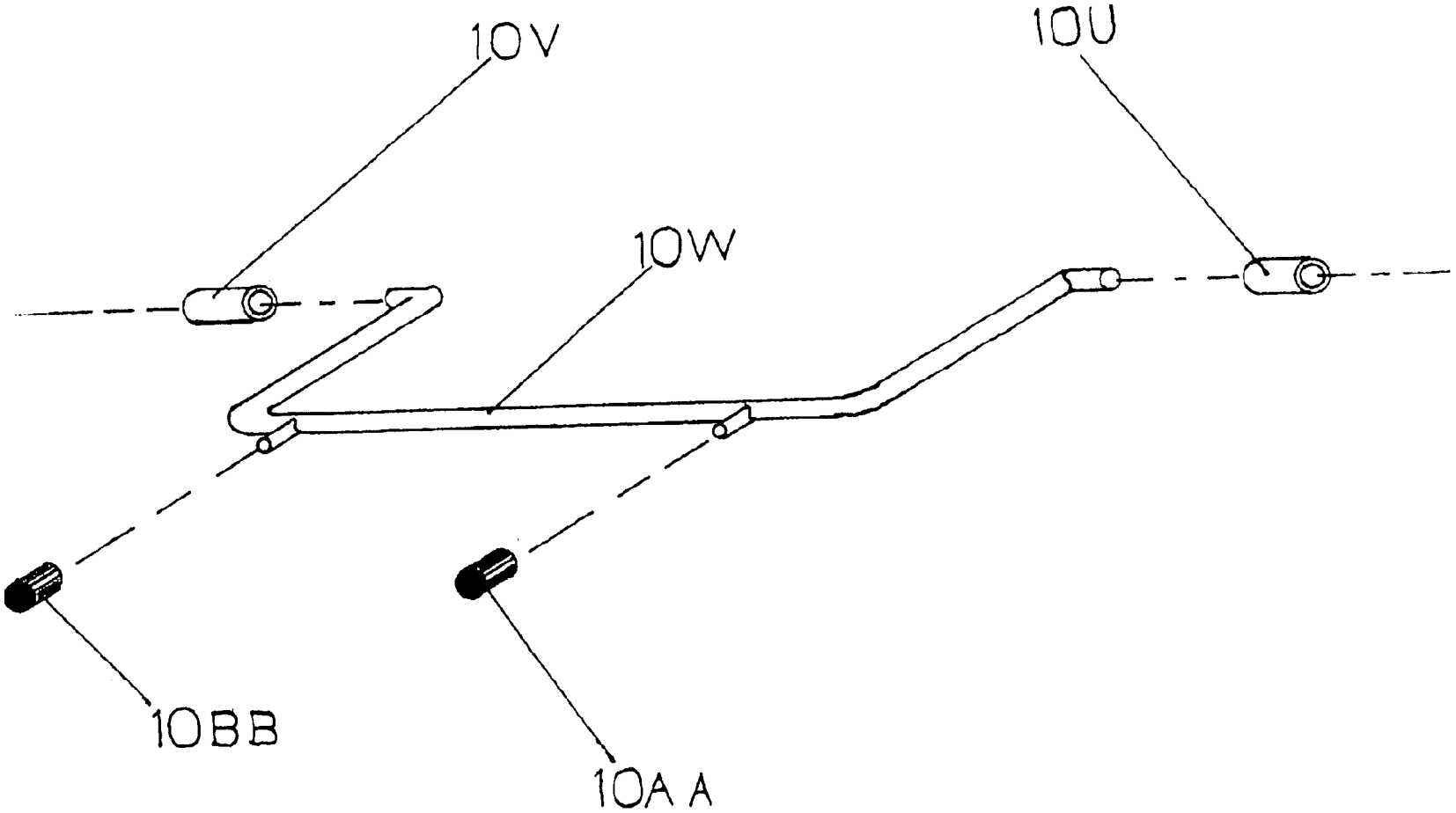

FIG. 11 shows backrest support 10W, and indicates the placement of backrest leg receiver sockets 10U, and 10V, onto posts protruding from upper parts of backrest support 10W. FIG. 11 also shows the placement of floor protectors 10AA, and 10BB, made of rubber or some other suitable material, onto additional protrusions located on backrest support 10W, at points where it contacts a floor when extended.

Figure 10:
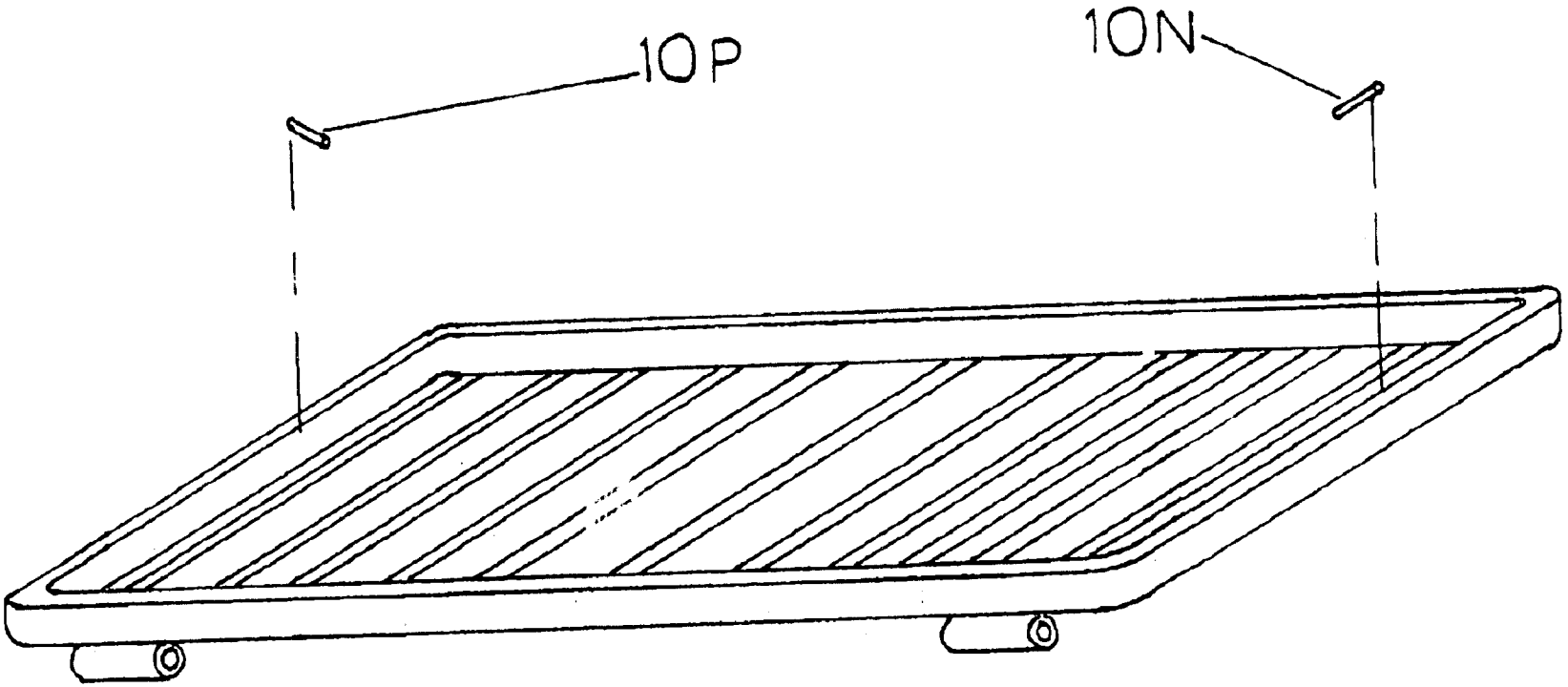
FIG. 10 shows a partially completed backrest 10 from FIG. 9, as well as the placement of sub-parts: backrest chain hooks 10N and 10P. These parts are welded where indicated in the drawing, further constructing backrest 12.
Figure 12:
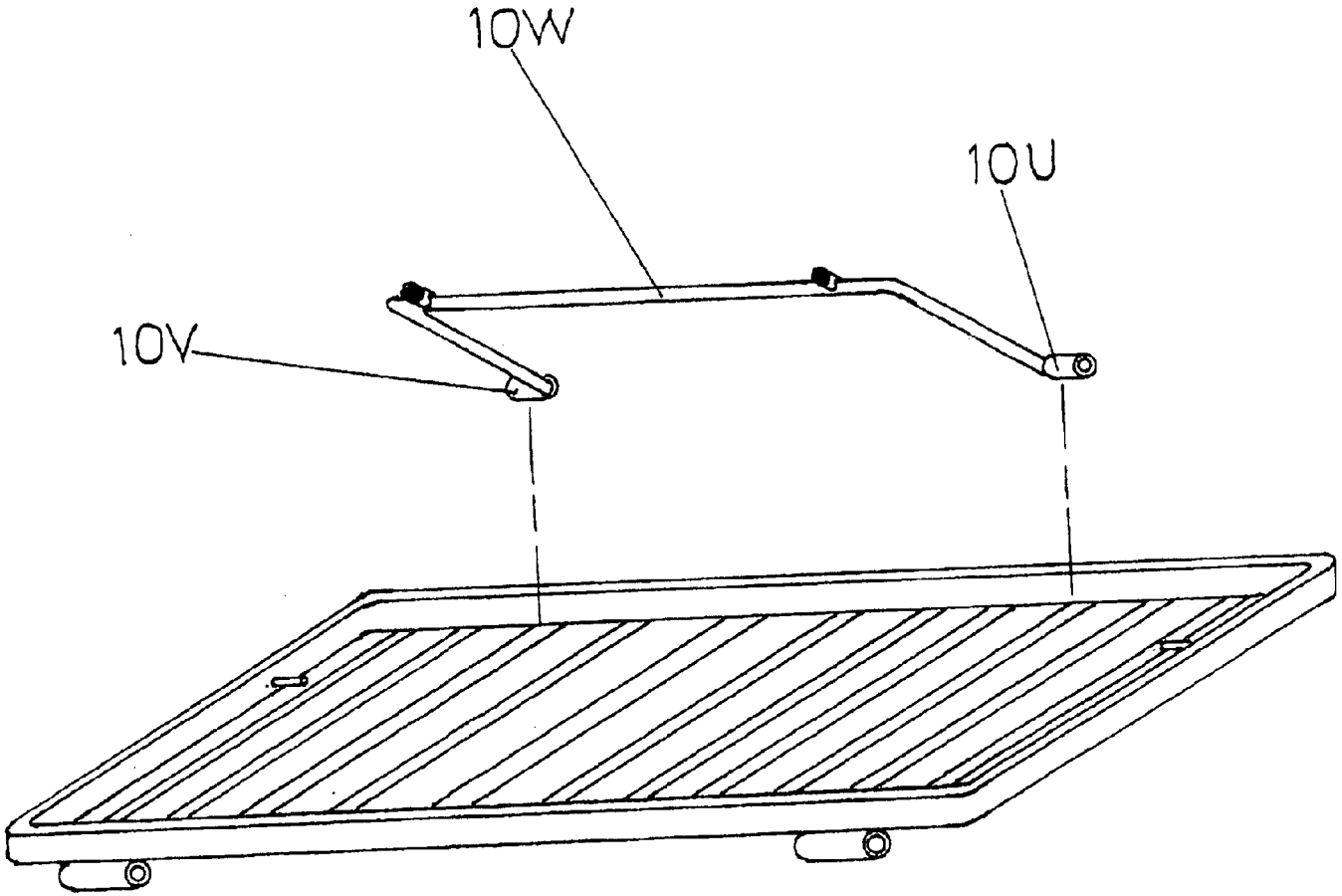

FIG. 12 shows a backrest support 10W, with backrest leg receiver sockets 10U, and 10V, and floor protectors 10AA and 10BB in place. FIG. 12 further shows the placement of backrest support receiver sockets 10U and 10V onto a partially completed backrest 10 from FIG. 10. Backrest support receiver sockets 10U and 10V are welded or otherwise permanently attached where indicated thus completing backrest 10 and leaving backrest support 10W free to swing outward from backrest 10.

Figure 13:
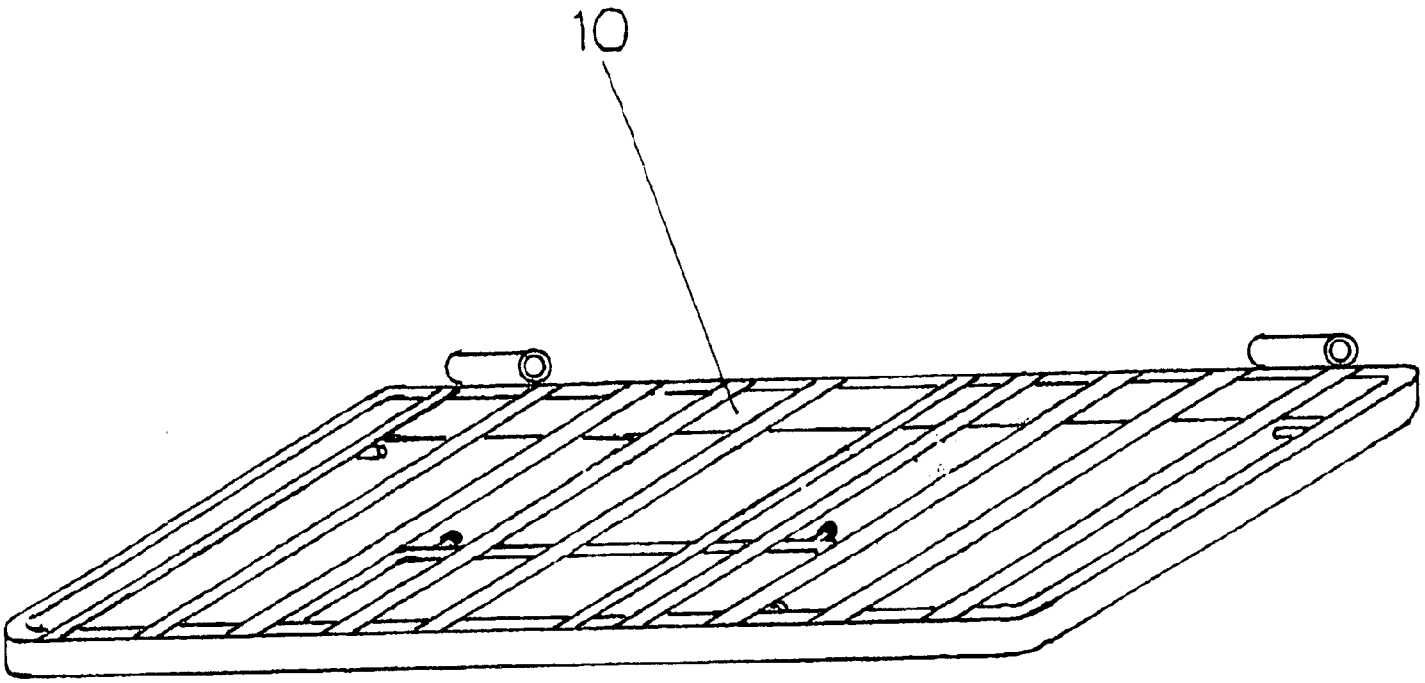

FIG. 13 shows a completed backrest 10 viewed from the front. All sub-parts are at least partially visible with the exception of backrest support receiver socket 10V, which is obscured by slat 10C.

Figure 14:
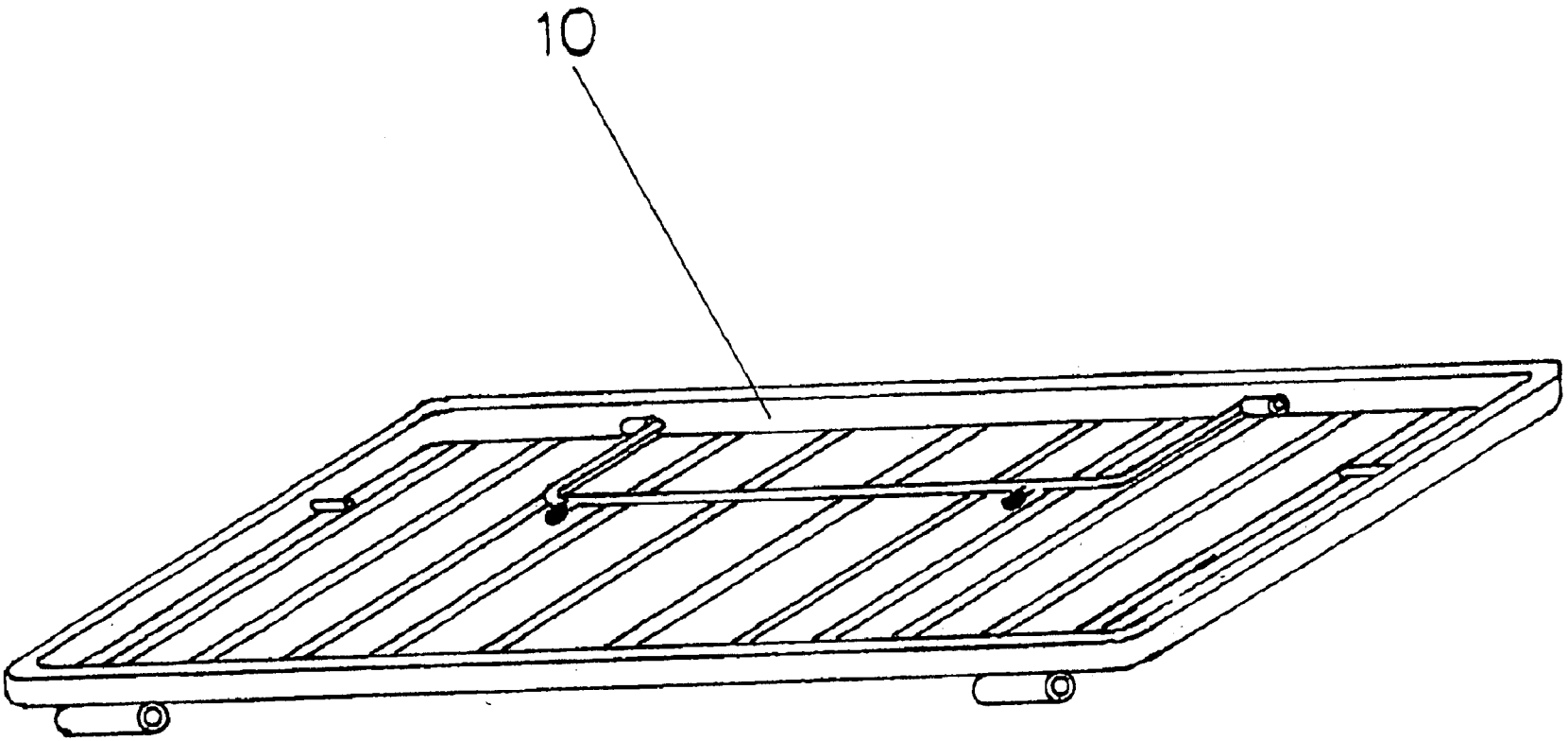

FIG. 14 shows a completed backrest 10 viewed from the back. All sub-parts are visible. Backrest support 10W is folded into backrest 10.

Figure 15:
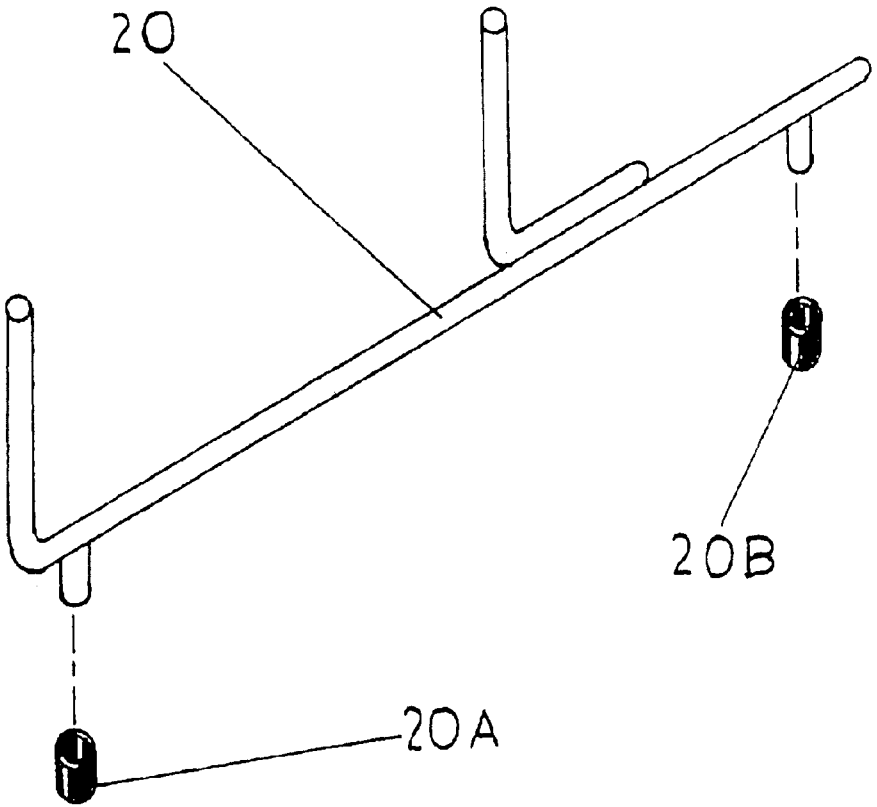

FIG. 15 depicts left leg 20. Both legs are identical. FIG. 15 also shows the placement of floor protectors 20A and 20B.

Figure 16:
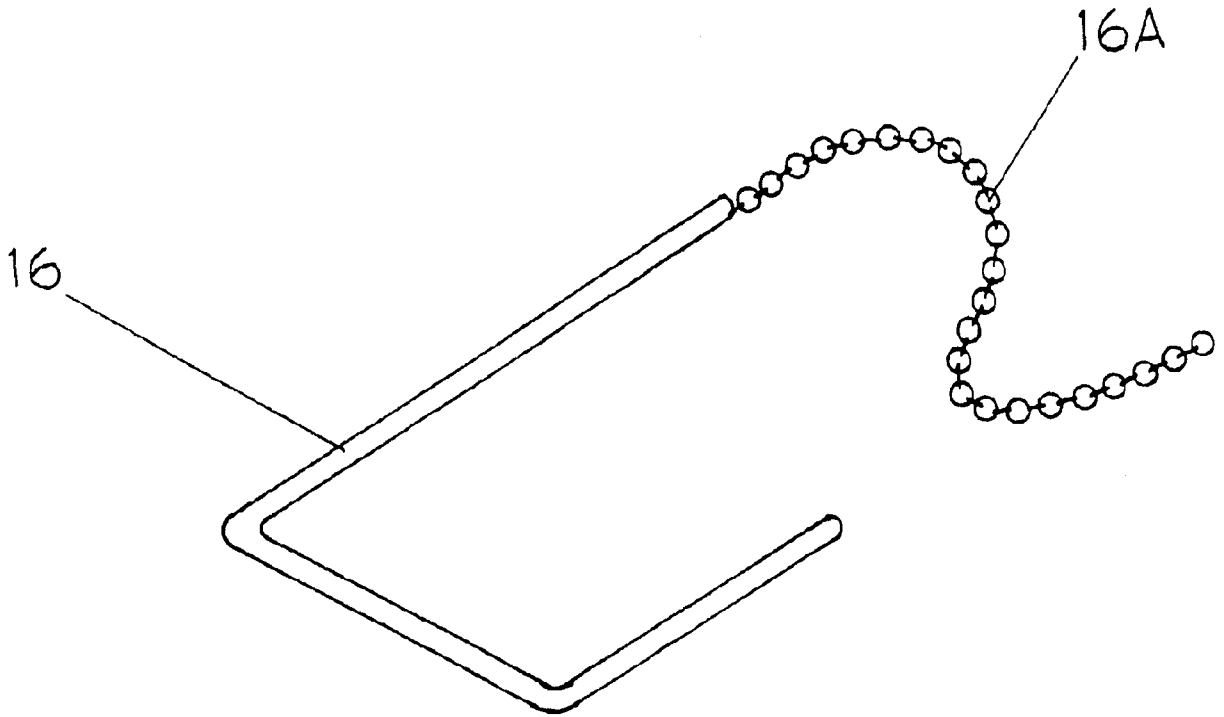

FIG. 16 depicts left armrest 16, both armrests are identical. The same figure shows the placement of backrest support chains 16A. Both sub-parts 14A and 16A are welded or otherwise permanently attached to the uppermost and rearmost ends of armrests 14 and 16.

Figure 17:
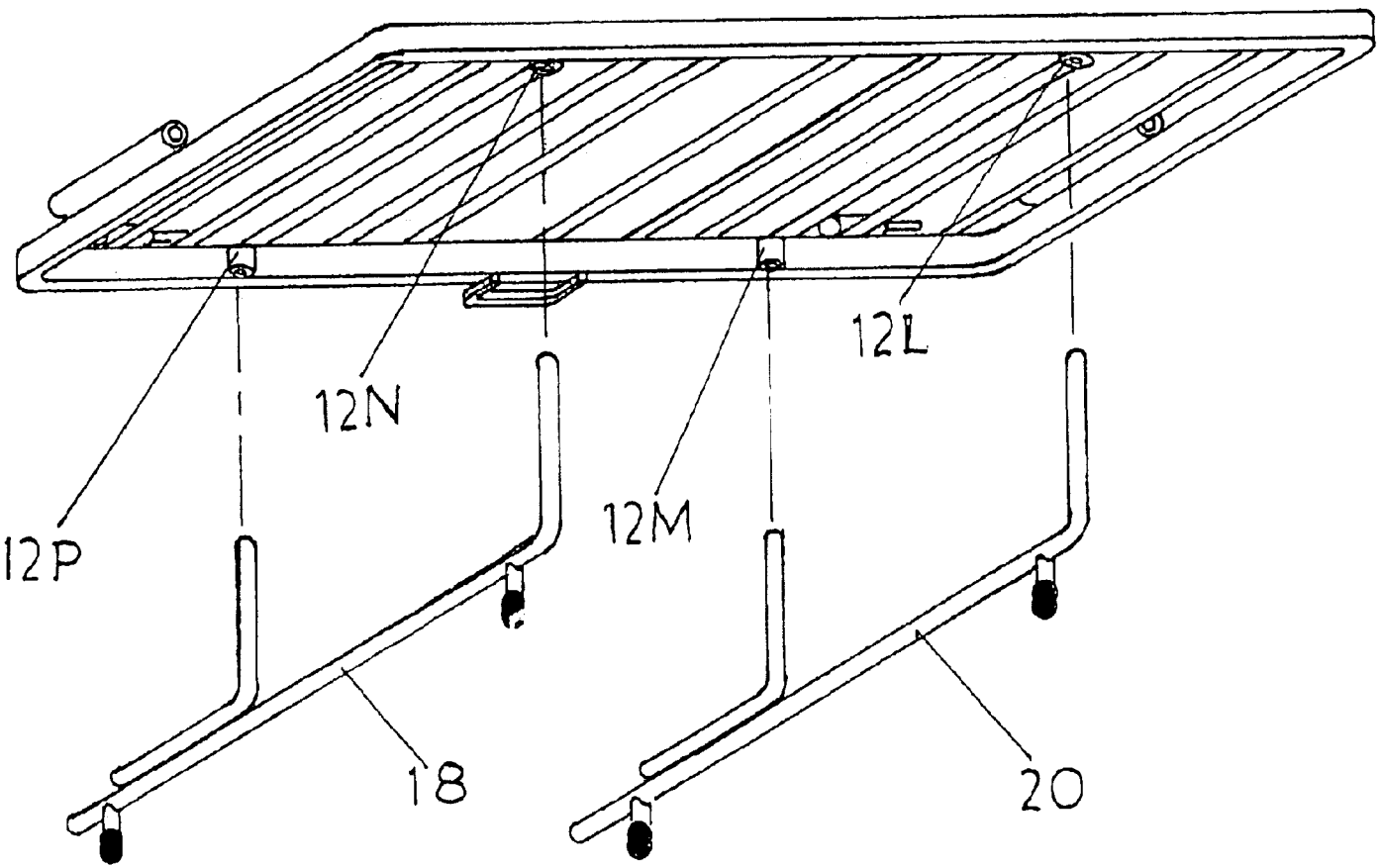

FIG. 17 shows a seat 12 seen from below as well as legs 18 and 20. Lines indicate the insertion of the uppermost ends of legs 18 and 20 into corresponding leg receiver sockets 12L, 12M, 12N, and 12P, to form a supporting base for the overall structure.

Figure 18:
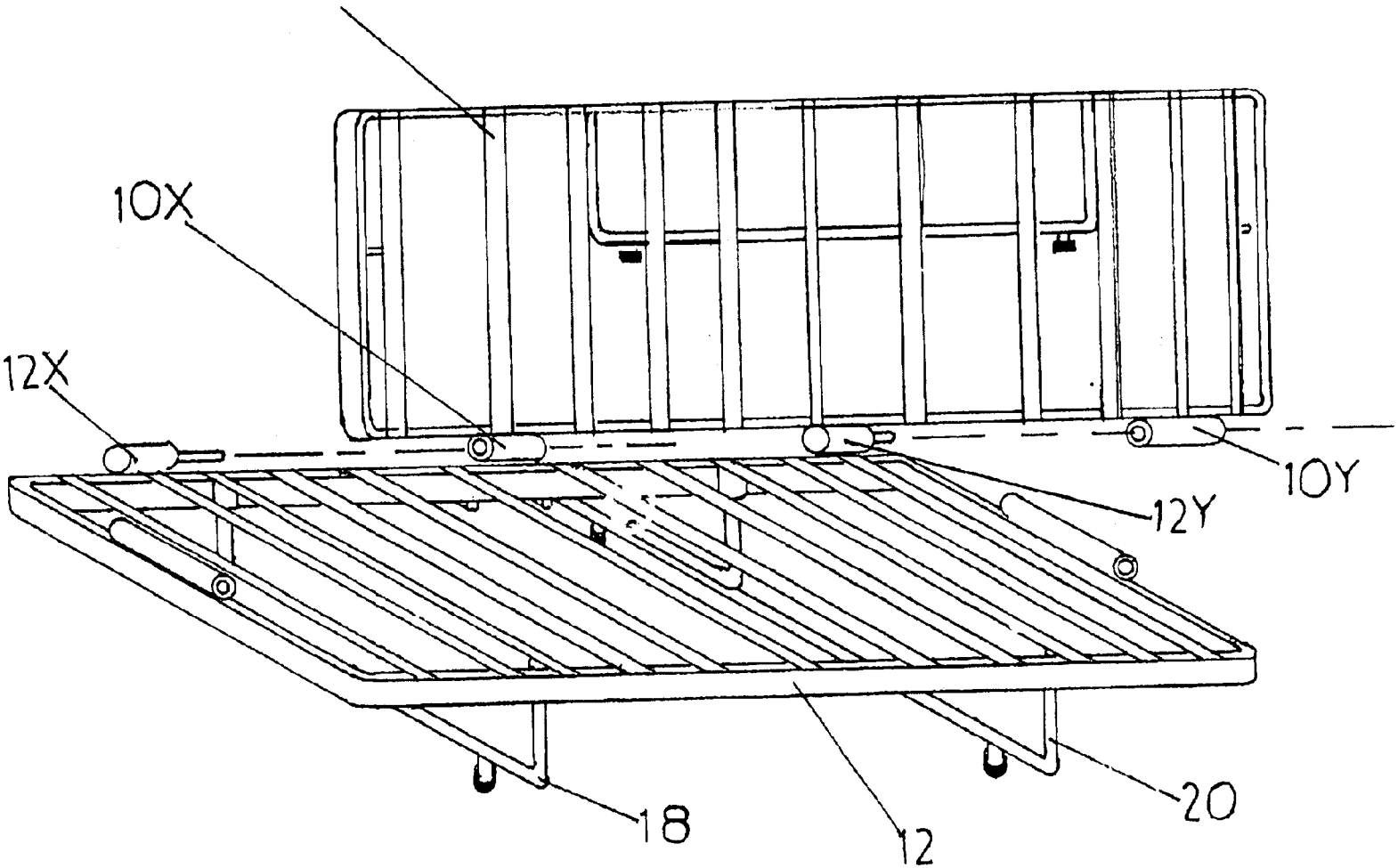

FIG. 18 shows a seat 12 with legs 18 and 20 in place. Additionally FIG. 18 shows a backrest 10 with lines indicating how female half slip hinges 10X and 10Y, are placed onto male half slip hinges 12*x* and 12Y. One hinge pin of either 12X or 12Y is shorter than that of its counterpart.

Figure 19:
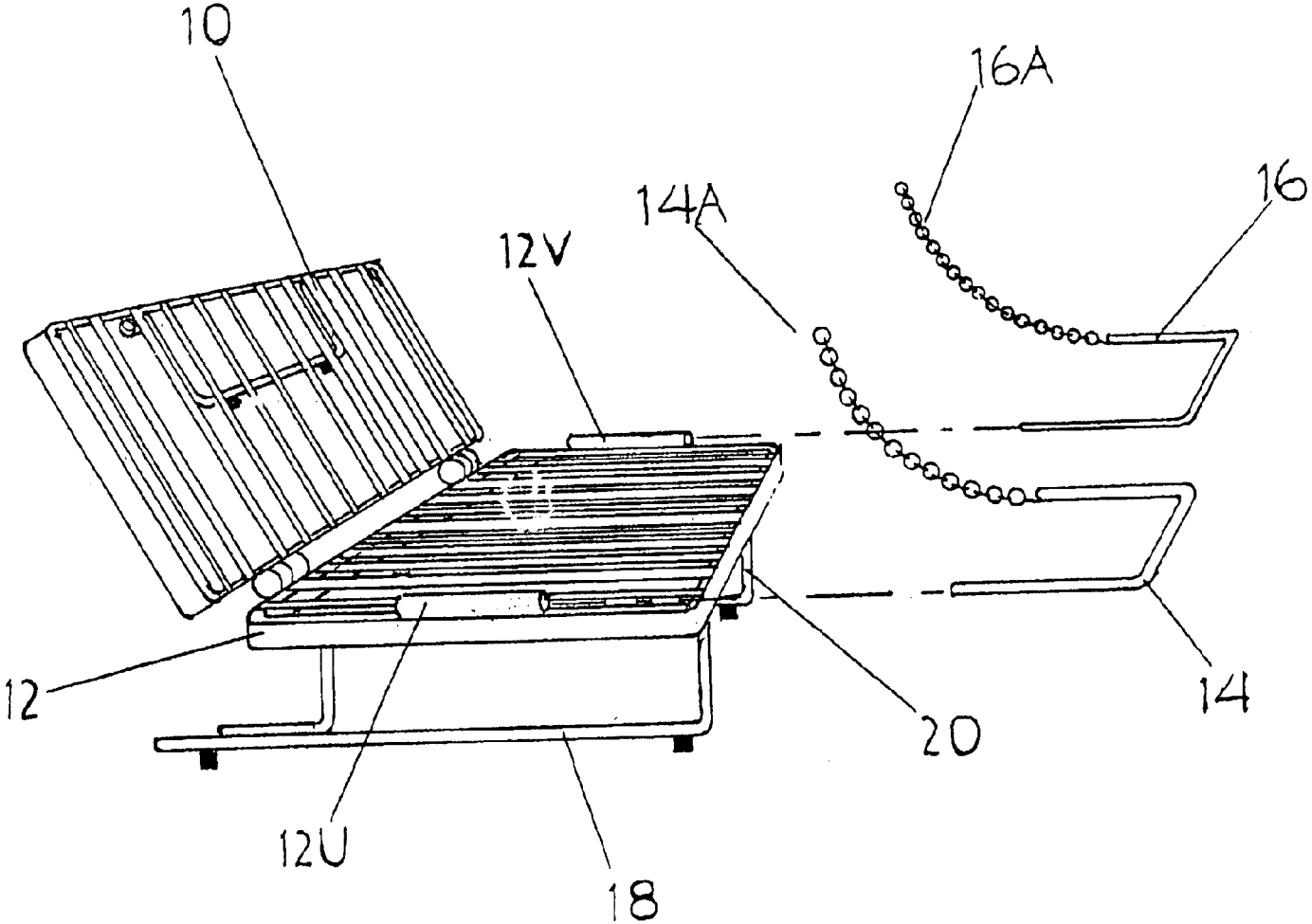

FIG. 19 shows a seat 12 with legs 18 and 20 in place and with backrest 10 positioned onto seat 12. FIG. 19 also shows armrests 14 and 16. Lines indicate the insertion of the lower and rearmost ends of 14 and 16 into armrest receiver sockets 12U and 12V. Backrest support chains 14A and 16A are also shown.

Figure 20:
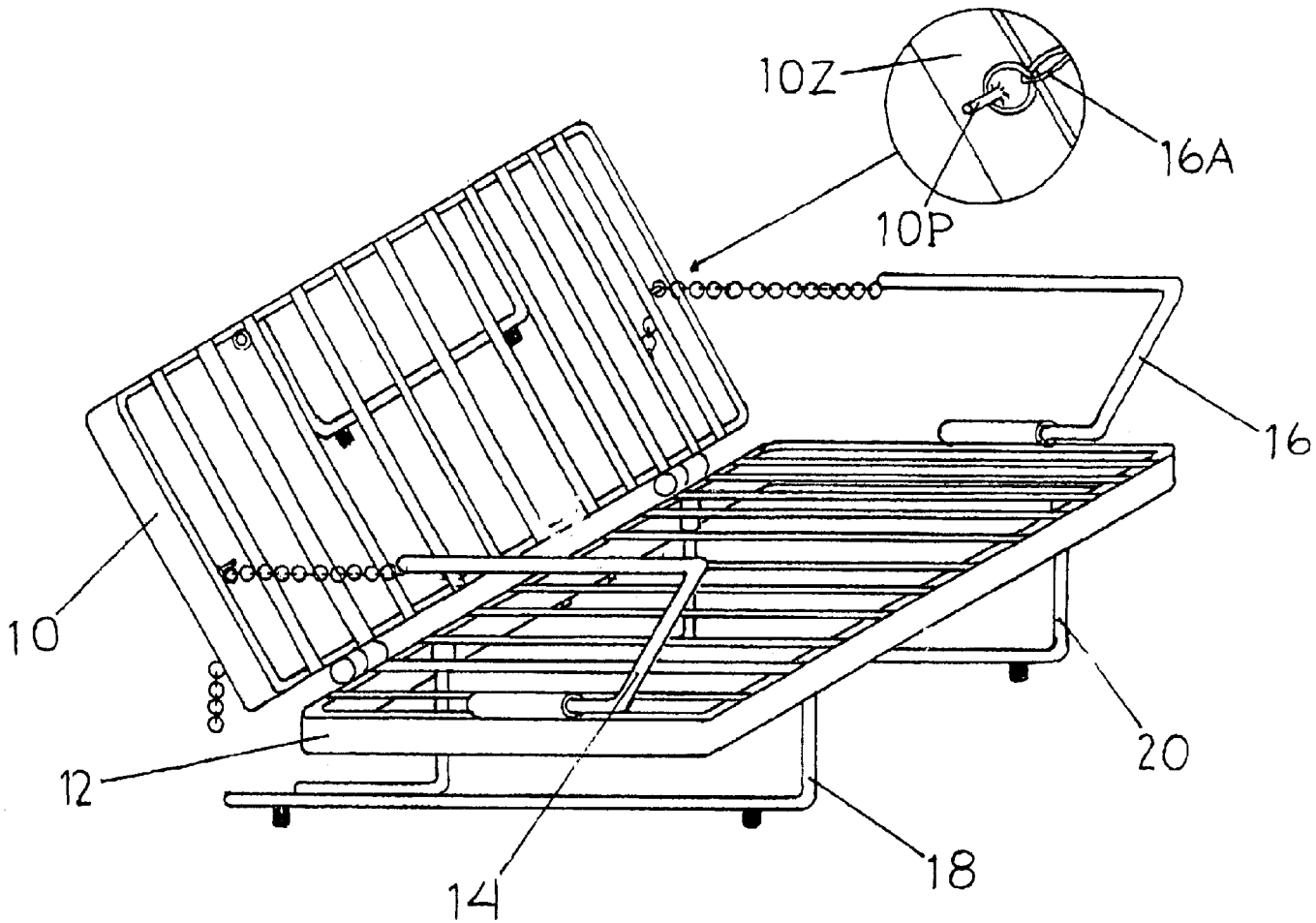

FIG. 20 shows seat 12, legs 18 and 20, backrest 10, and armrests 14 and 16, assembled and in place. FIG. 20 also shows backrest support chains 14A and 16A attached to backrest support chain hooks 10N and 10P. An inset details the method their of attachment.

OPERATION

The manner of using the futon frame that assembles by means of sockets is substantially different from the manner in which prior art futon frames are used and assembled and is as follows.

A user assembles the futon frame by first inserting appropriate ends of legs 18 and 20, into corresponding leg receiver sockets 12L, 12M, 12N, and 12P which are permanently secured to seat 12. This step is illustrated in FIG. 17.

A user then turns this assembly, comprised of seat 12 and legs 18 and 20, so that legs 18 and 20, rest on a floor and support seat 12 above said floor.

Next a user inserts the ends not having backrest support chains 14A and 16A attached, of armrests 14 and 16, into the forward facing ends of armrest receiver sockets 12U and 12V, as shown in FIG. 19.

The user then attaches backrest 10 to seat 12 by placing female half slip hinges 10U and 10V, onto male half slip hinges 12U and 12V. This is made easier by the fact that one of the male half slip hinge pins is shorter than the other. By this means the user can partially place one female half slip hinge onto the longer corresponding male half, stabilizing the backrest so that the user can more easily place the remaining female half slip hinge onto the shorter corresponding male half. This step in the assembly is illustrated in FIG. 18.

The user can then configure the futon in a couch position by attaching one link of each of backrest support chains 14A and 16A, to its corresponding backrest chain hooks 10N and 10P, said backrest support chains thus supporting, in conjunction with armrests 14 and 16, backrest 10 in an upright position. This step in the user assembly process is detailed in FIG. 20.

A futon 26 is placed on the futon frame and folded to conform to a couch position. Once the futon frame is configured in a couch position the angle of inclination of the backrest can be easily adjusted to any of several positions. This is done by increasing or decreasing the distance between armrests 14 and 16, and backrest chain hooks 10N and 10P. This is accomplished by unhooking backrest support chains 14A and 16A, from corresponding backrest chain hooks 10N and 10P, then reattaching backrest support chains 14A and 16A, to corresponding backrest chain hooks 10*n* and 10P, using links different from those previously used.

Once assembled, the futon frame of our invention is made into a bed by first disconnecting backrest support chains 14A and 16A, from corresponding backrest chain hooks 10N and

Figure 1:
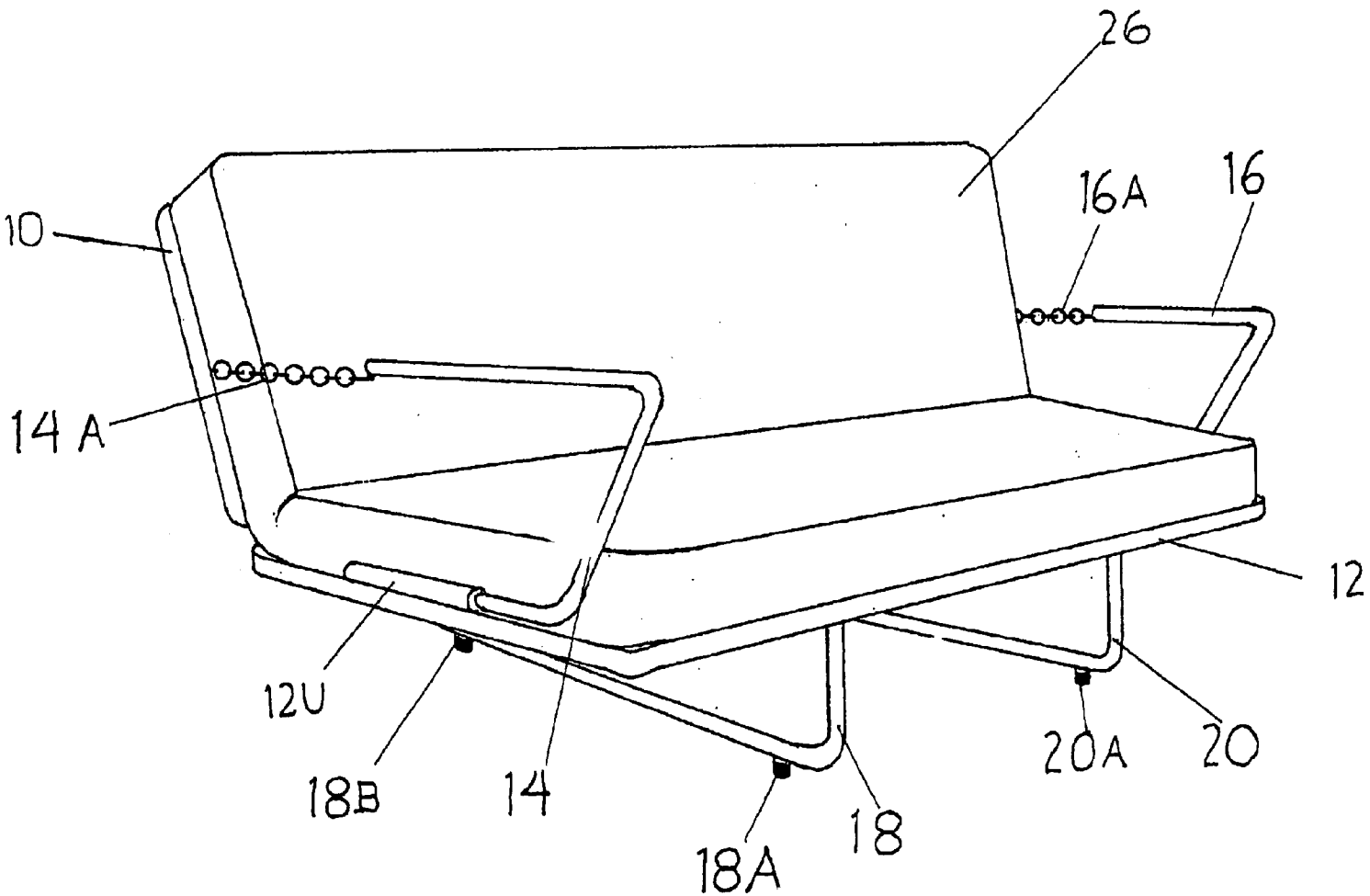
Figure 2:
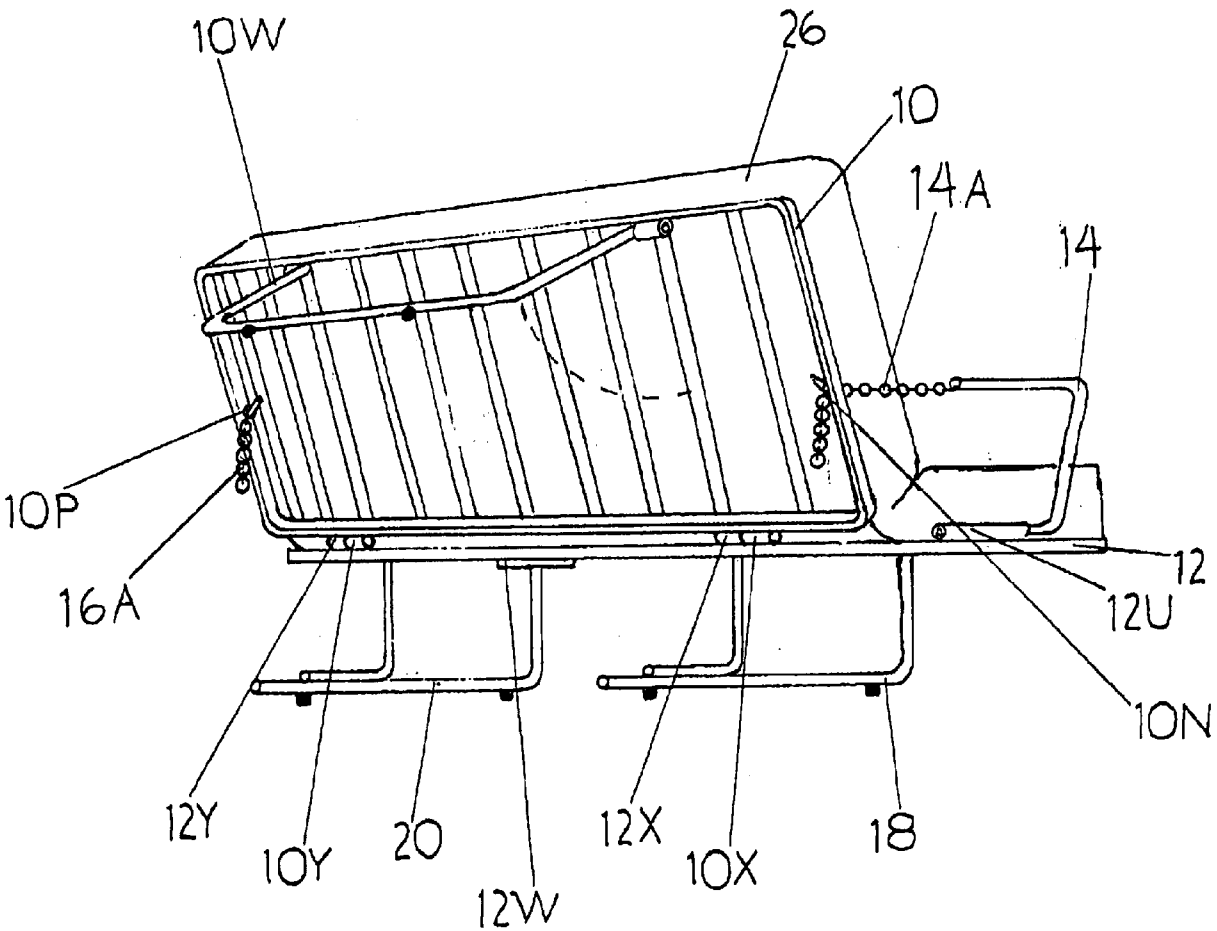
Figure 3:
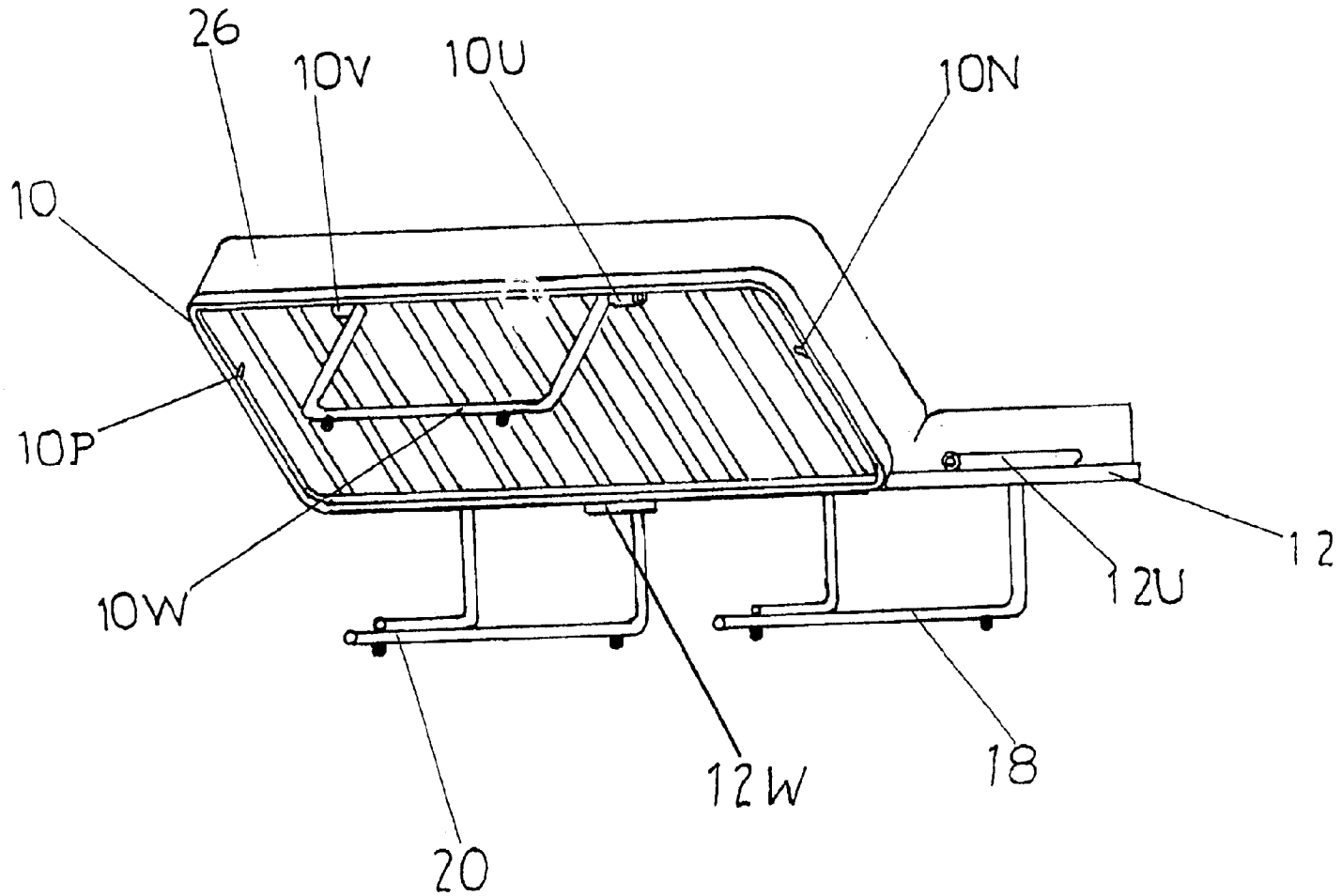
Figure 4:
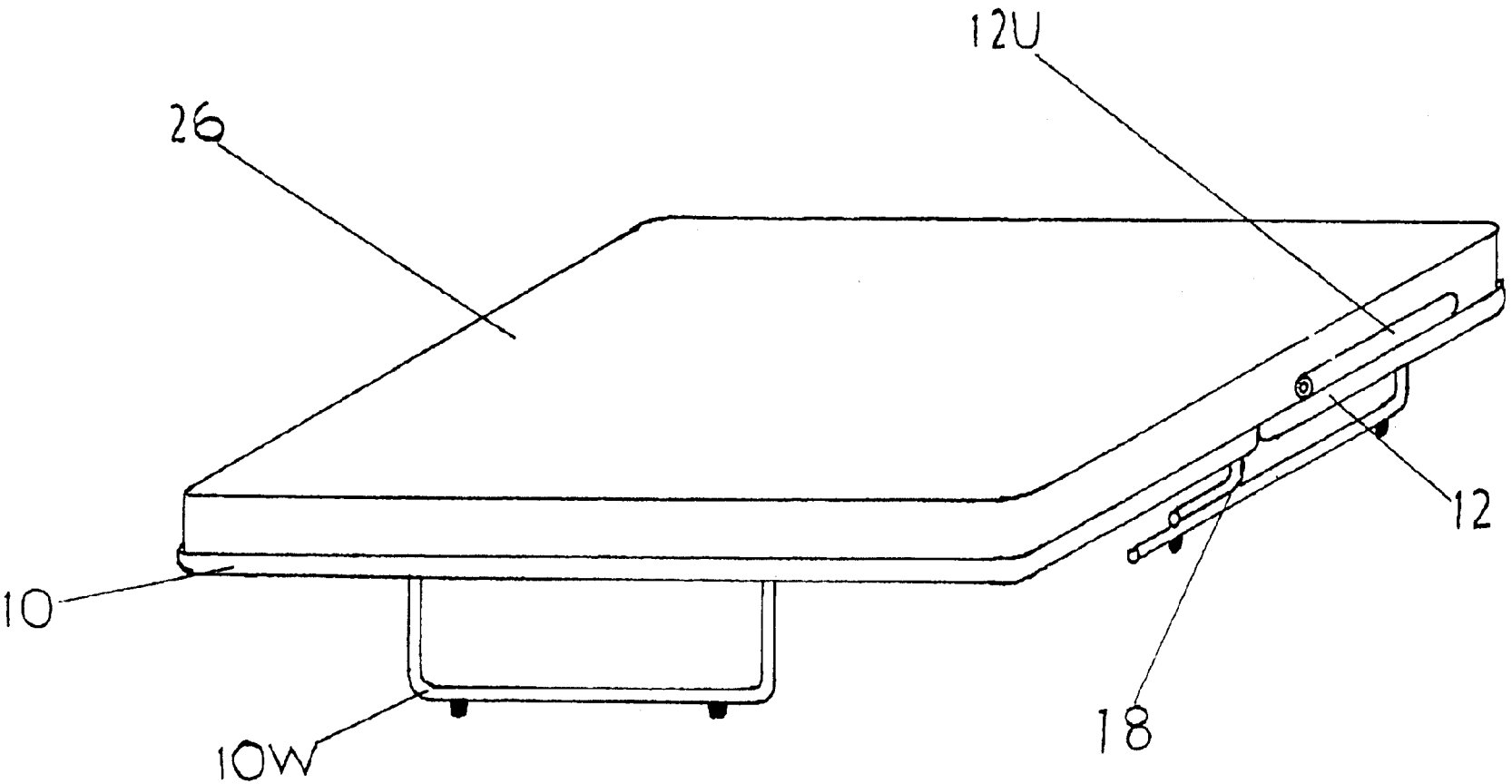
Figure 5:
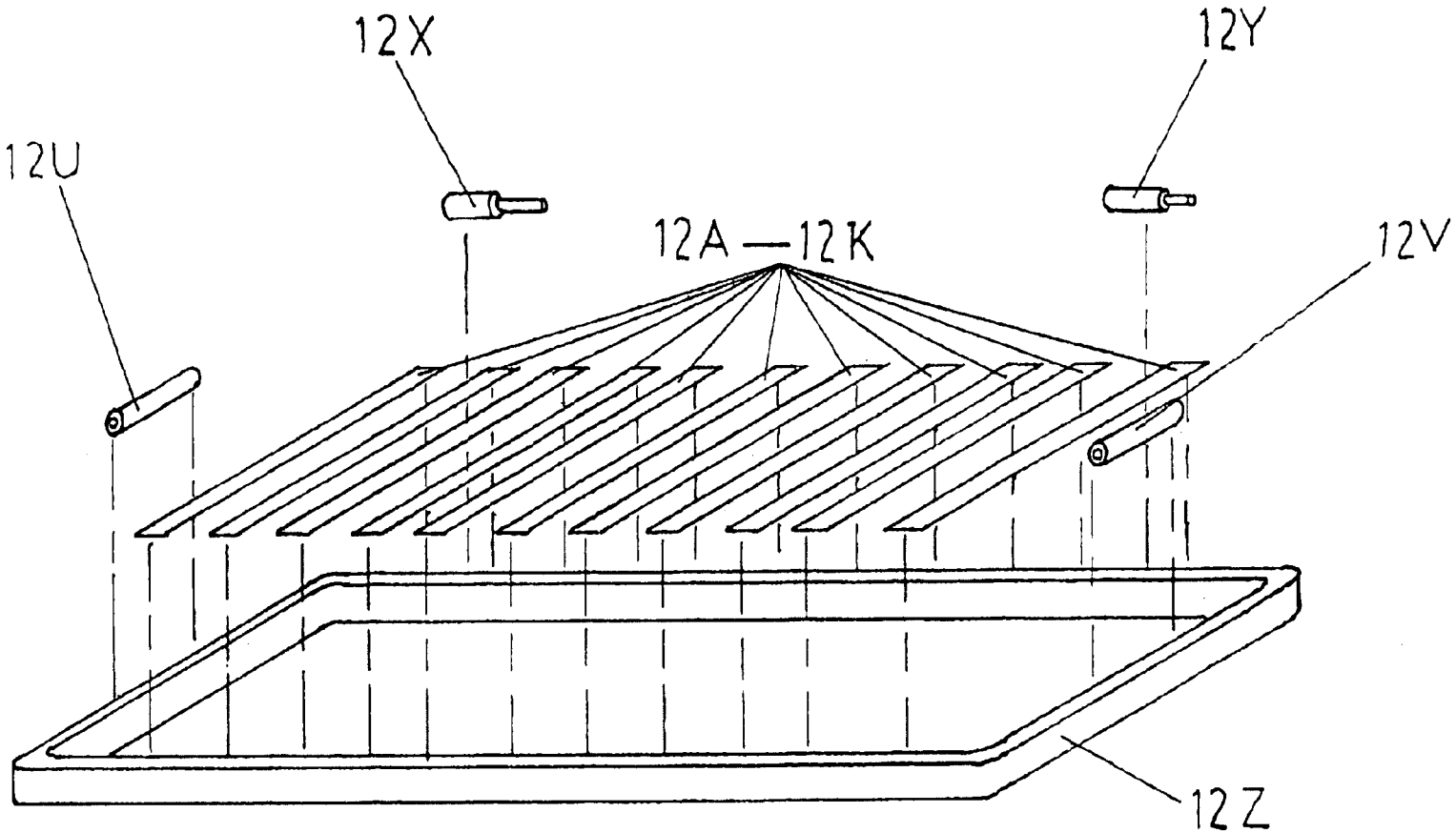
FIG. 5 shows the assembly of sub-parts: seat perimeter 12Z, male half slip hinges 12X and 12Y, slats 12A through 12K, and armrest receiver sockets 12U and 12V. These parts are welded or otherwise permanently attached to one another, in the locations indicated in FIG. 5 to partially construct seat 12.
Figure 6:
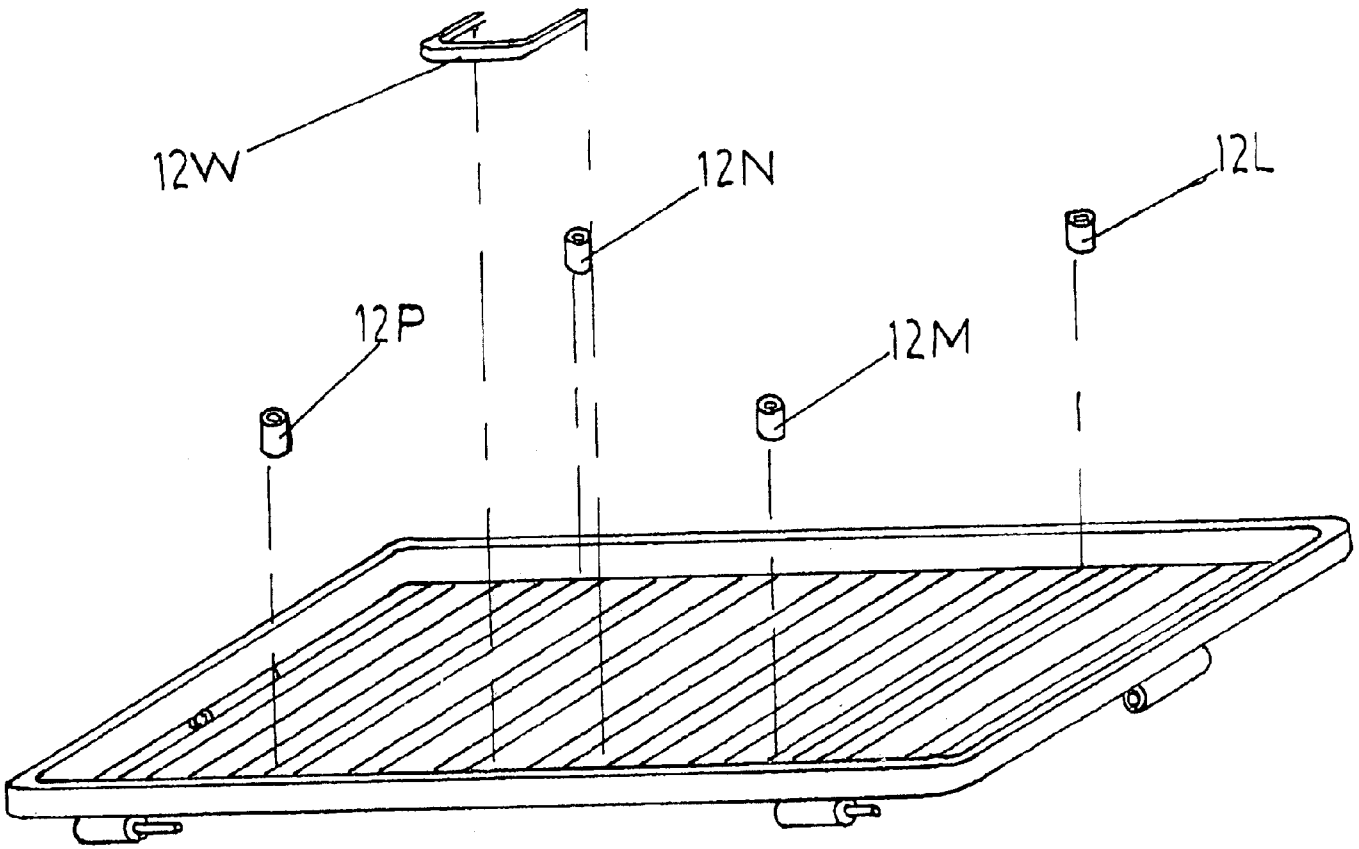
FIG. 6 shows a partially completed seat 12 from FIG. 5, as well as the placement of sub-parts: leg receiver sockets 12L, 12M, 12N, 12P, center support 12W. These parts are welded or otherwise permanently attached where indicated in the drawing to complete seat 12.
Figure 7:
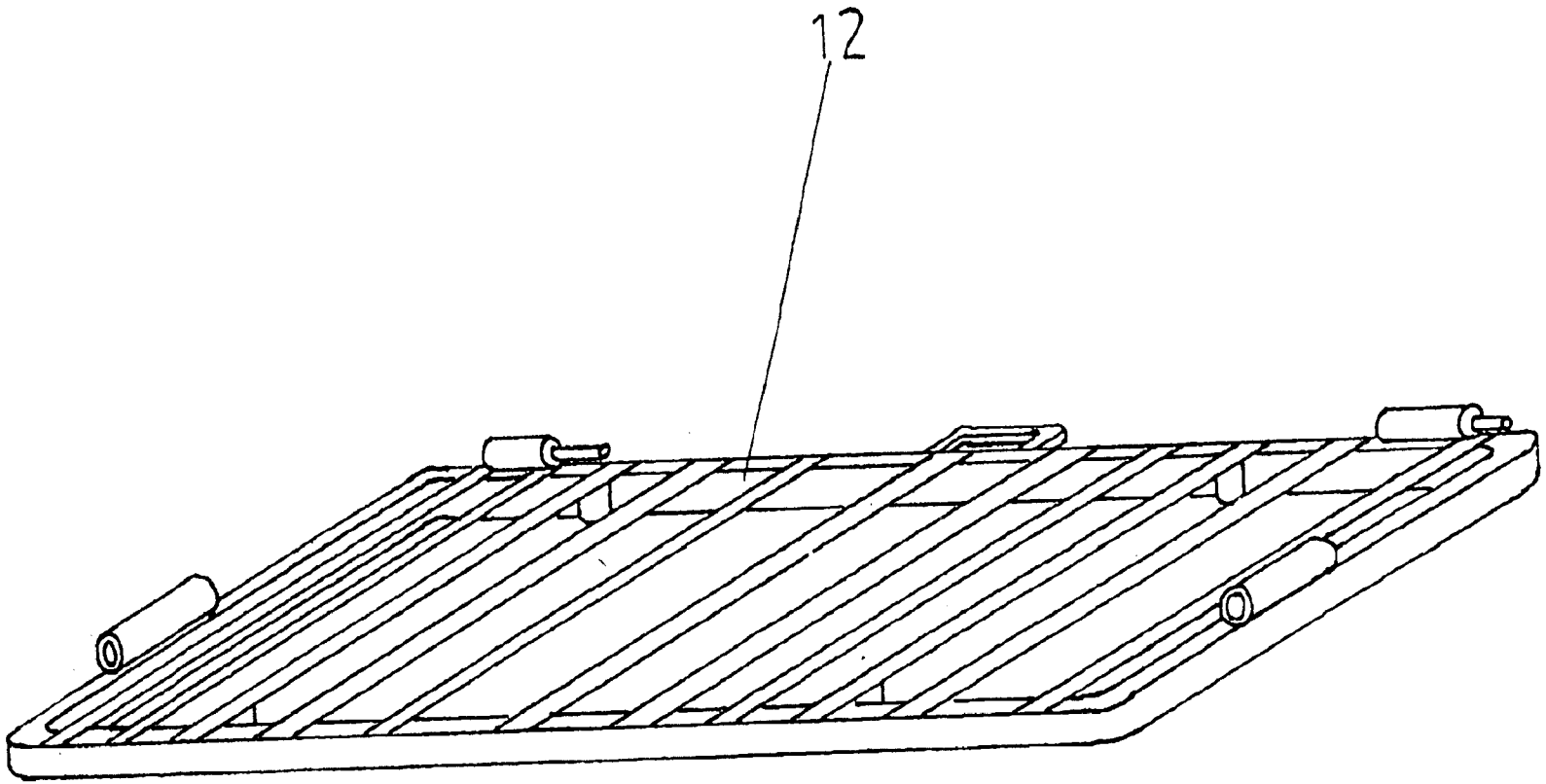
FIG. 7 shows a completed seat 12 seen from above. Viewed from this position all sub-parts are at least partially visible.
Figure 8:
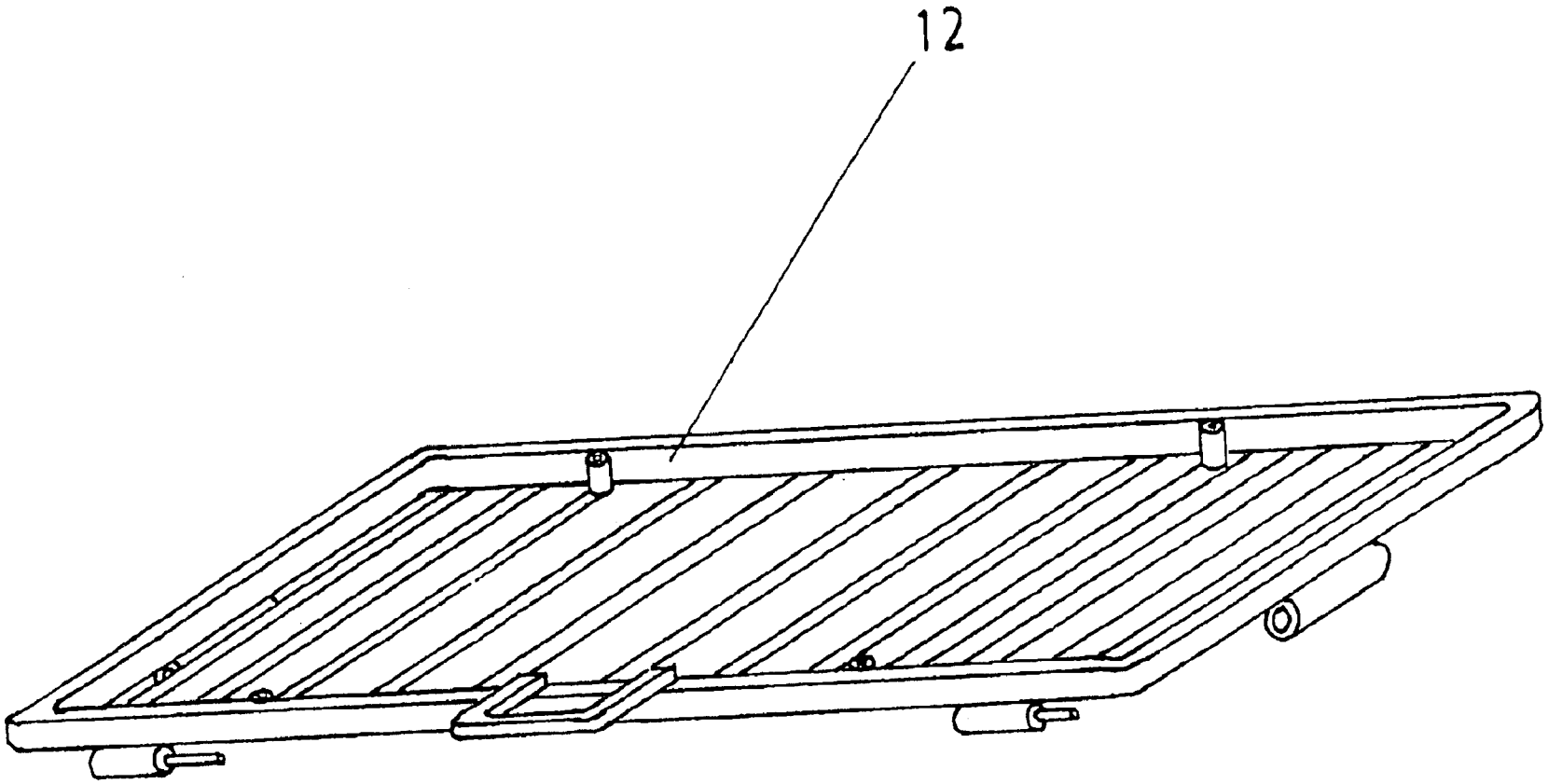
FIG. 8 shows a completed seat 12. In this view all sub-parts are at least partially visible.
Figure 9:
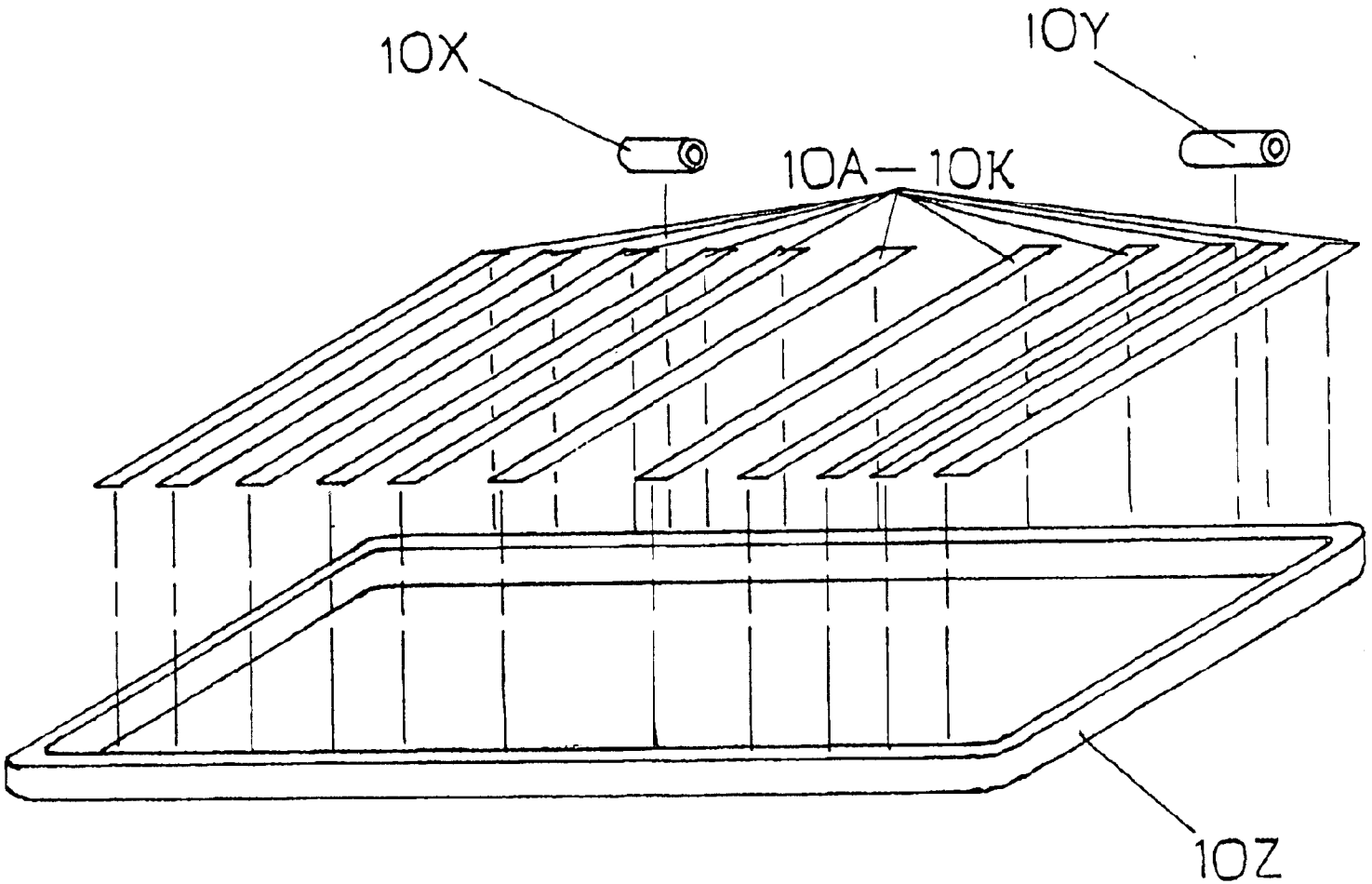
FIG. 9 shows the assembly of sub-parts: slats 10A through 10K, female half slip hinges 10X and 10Y, and seat perimeter 10Z. These parts are welded or otherwise permanently attached to one another in the manner indicated to partially construct backrest 10.

10P. The user then grasps backrest leg 10W and pulls, filly extending it to a position perpendicular to backrest 10. This step is illustrated in FIG. 2. Backrest 10 can then be lowered so that the lower portion of backrest leg 10W rests on the floor maintaining, in conjunction with center support 12W, backrest 10, in a position coplanar with seat 12. Finally armrests 14 and 16 are folded inward and underneath futon 26, or are removed entirely by sliding their lower ends out of armrest receiver sockets 12U and 12V.

CONCLUSION, RAMIFICATION, SCOPE

The futon frame of our invention can be disassembled as easily as it is assembled in about two minutes simply by reversing the assembly process. No tools are required. This allows a far greater degree of portability than prior art futon frames.

Further, our invention, while it can be made of wood or thin metal tubing, is not likely to be. For this reason it offers an enormous advantage in terms of durability over prior art futon frames currently being sold.

The mechanisms which comprise our futon frame are far simpler than those of prior art futon frames, and are therefore much less frustrating for a user. The simplicity of the mechanisms comprising our invention makes it likely that it will remain operational far longer than prior art futon frames.

There are no small parts which can be lost, and the backrest can be adjusted to several reclining positions.

Although the description above contains much specificity, this should not be construed as limiting the scope of the invention, but as merely providing illustrations of the presently preferred embodiments of the invention. For example the shapes of the arms might be different from those in the drawing figures such as angular or hemispherical; the sockets illustrated are circular in cross section, conceivably the armrests, legs, and sockets can have almost any cross sectional shape, square for instance.

Instead of crutch foot type floor protectors a manufacturer might opt for simple rubber tubing over the floor, contacting surfaces; chains might instead be cables or ropes with built in stops, a rigid extension of the armrests with stops, etc. The embodiment described above is constructed of metal; however, wood, plastic, or other material could be used.

Thus the scope of the invention should be determined by the appended claims and their legal equivalents, rather than by the examples given.

What is claimed is:

1. An article of furniture capable of being configured as a seat or as an article of furniture on which a person or animal could lie down and capable of being assembled and disassembled easily at the discretion of a user without any use of small fastening devices such as nuts and bolts or the like comprising a seat, a backrest, one or more armrests and one or more legs as parts which, themselves cannot be further disassembled:

(a) said legs being secured to said seat by means of sockets permanently attached to said seat and into which are inserted aspects of said legs, (b) said armrests being secured to said seat by means of sockets permanently attached to said seat and into which are inserted aspects of said armrests, and (c) said backrest being secured to said seat by means of sockets permanently attached to said seat and into which are inserted aspects of said backrest or sockets permanently attached to said backrest and into which are inserted aspects of said seat, said backrest capable of articulating with respect to said seat in the manner of two halves of a book and capable of being easily disconnected from and connected to said seat through said means of sockets and having means for supporting said backrest in a position coplanar with said seat comprising one or more legs which, when employed extend outward from said backrest in a manner which forms a support for the backrest.

2. The article of furniture of claim 1 having one or more stays attached to said armrests, said stays having junctions capable of interfacing with said backrest for the purpose of maintaining said backrest in a position principally perpendicular to said seat, said junctions being capable of being easily and manually released by a user from their attachment to said backrest to allow said backrest to be lowered to a position coplanar with said seat.

3. The article of furniture of claim 2 with stays and junctions mentioned in claim 2 having the additional purpose of allowing for the adjustment of said backrest to two or more reclining positions through the selection and placement on the backrest of various junctions thereby modifying the distance from the armrest to the backrest when the article of furniture configured in a seat position.

* * * * *